US007463224B2

(12) United States Patent
Sano

(10) Patent No.: US 7,463,224 B2
(45) Date of Patent: Dec. 9, 2008

(54) LIGHT EMITTING DEVICE AND DISPLAY DEVICE

(75) Inventor: Keiichi Sano, Taipei (TW)

(73) Assignee: Sanyo Electric Co., Ltd. (JP)

( * ) Notice: Subject to any disclaimer, the term of this patent is extended or adjusted under 35 U.S.C. 154(b) by 739 days.

(21) Appl. No.: 10/871,202

(22) Filed: Jun. 18, 2004

(65) Prior Publication Data

US 2005/0024351 A1 Feb. 3, 2005

(30) Foreign Application Priority Data

Jun. 20, 2003 (JP) ..... 2003-177267
Jun. 9, 2004 (JP) ..... 2004-170835

(51) Int. Cl.
*G09G 3/30* (2006.01)

(52) U.S. Cl. ..... 345/76; 345/39; 345/45; 345/46; 345/80; 345/82; 315/169.1; 315/169.3

(58) Field of Classification Search ..... 345/30, 345/33, 44–46, 76, 82, 83, 204–206
See application file for complete search history.

(56) References Cited

U.S. PATENT DOCUMENTS 6,730,966 B2 5/2004 Koyama
6,777,710 B1 * 8/2004 Koyama ..... 257/59
6,858,991 B2 * 2/2005 Miyazawa ..... 315/169.3
6,861,810 B2 * 3/2005 Rutherford ..... 315/169.3
7,109,952 B2 * 9/2006 Kwon ..... 345/76

FOREIGN PATENT DOCUMENTS

JP 2002-149112 5/2002

* cited by examiner

*Primary Examiner*—Richard A. Hjerpe
*Assistant Examiner*—Jennifer T Nguyen
(74) *Attorney, Agent, or Firm*—Cantor Colburn LLP

(57) ABSTRACT

Each pixel in a display device includes an emissive element, a driver transistor, a control transistor, and a control capacitor. The driver transistor is provided between the emissive element and a power supply and controls supply of power from the power supply to the emissive element. The control transistor is connected between a constant voltage power supply and a gate of the driver transistor, receives a digital data signal on a gate, and controls whether or not to fix a gate voltage of the driver transistor. The control capacitor is connected between a control line and the gate of the driver transistor. The gate voltage of the driver transistor is shifted to a voltage corresponding to a control pulse signal when the control transistor is off and is non-fixed during a light emission period defined by the control pulse signal applied to the control line.

14 Claims, 3 Drawing Sheets

LIGHT EMITTING DEVICE AND DISPLAY DEVICE

CROSS-REFERENCE TO RELATED APPLICATIONS

The Japanese priority applications Numbers 2003-177267 and 2004-170835 upon which this patent application is based are hereby incorporated by reference.

BACKGROUND OF THE INVENTION

1. Field of the Invention

The present invention relates to a display device, and in particular to a digital display device having a display element such as an emissive element in each pixel and in which the elements are operated using digital signals to represent gradations.

2. Description of the Related Art

Because electroluminescence (hereinafter simply referred to as "EL") display devices in which a self-emitting EL element, for example, is used as an emissive element in each pixel have advantages such as that the device is thin, self-emitting, and consumes less power, EL display devices have attracted much attention as alternatives to display devices such as liquid crystal display (LCD) and cathode ray tube (CRT) display devices.

In particular, a high resolution display can be achieved by an active matrix EL display device in which a switching element such as a thin film transistor (hereinafter simply referred to as "TFT") for individually controlling an EL element is provided in each pixel and the EL element in each pixel is controlled.

In an active matrix EL display device, a plurality of pixels, a plurality of selection lines (gate lines) extending along a horizontal scan direction (row direction), a plurality of data lines and power supply lines extending along a vertical scan direction (column direction) are provided over a substrate, and each pixel has an organic EL element, a selection TFT, a driver TFT, and a storage capacitor. In this structure, a selection signal is output to a selection line so that each of the selection TFTs connected to this line is switched on, a data signal (analog voltage signal) output onto the data line is supplied to the storage capacitor and to the driver TFT, the storage capacitor stores a voltage corresponding to the data signal for a predetermined period, and the driver TFT is operated to control electric current to be supplied from the power supply line through the organic EL element.

In addition to a method for driving each organic EL element with an analog data signal, a method is reported in which each organic EL element is driven with a digital data signal as shown in FIG. 1 (digital drive). In a pixel circuit shown in FIG. 1, a TFT 26 for switching current on and off is additionally provided, in a circuit structure for driving an EL element with an analog signal as already described, between an organic EL element 28 and a driver TFT 22 which is connected between an EL power supply and the organic EL element 28 for controlling supply of current to the organic EL element 28. When a selection signal is output to the gate line and the selection TFT 20 is switched on, a digital signal output onto the data line is supplied to and stored in the storage capacitor 24 through the selection TFT 20 and also is applied to a gate of the driver TFT 22.

The driver TFT 22 is switched on and off according to the digital data signal applied to its gate and the current on-off TFT 26 controls whether or not to supply the current flowing through the driver TFT 22 to the organic EL element 28 to allow the organic EL element 28 to emit light. The current on-off TFT 26 is controlled to be switched on and off a plurality of times during one frame period (one screen display period) through time divisional control corresponding to a number of bits in the digital data, to thereby control the total cumulative light emission period during one frame period for the organic EL element 28. Because light emission intensity as recognized by a viewer differs depending on the length of light emission period within one frame period, with the time divisional light emission control as described, it is possible to represent gradations. In other words, light emission gradation can be represented by merely controlling the length of light emission period of an organic EL element 28 during one frame period.

When a pixel circuit as shown in FIG. 1 is used and gradation is represented by a time divisional digital gradation drive method, in order to achieve a gradation display, analog control of the amount of current to be supplied to the organic EL element 28 is unnecessary, as the driver TFT 22 can be digitally operated to be switched on and off to supply or not supply current to the organic EL element 28. As such, when a current is to be supplied from the driver TFT 22 to the organic EL element 28, by setting a voltage of a data signal so that a large voltage which allows the on resistance of the driver TFT 22 to be sufficiently reduced is applied to the gate of the driver TFT 22, it is possible to reduce influences, to the light emission intensity of the organic EL elements 28 in the pixels, of variations in characteristics among TFTs. Thus, with a digital display method, it is possible to easily inhibit variation in display brightness, that is, display unevenness, among pixels.

In a circuit structure as shown in FIG. 1, however, the operations of switching on and switching off the driver TFT 22 must be directly controlled with a data signal to be applied to the gate of the TFT 22. Therefore, although the data signal is a digital signal, it is necessary to use a digital signal of a large amplitude for sufficiently securing on-off resistance ratio of the driver TFT 22 and to supply the data signal to the gate of the driver TFT 22.

In a matrix type display device, a plurality of pixels each having a circuit structure as shown in FIG. 1 are formed in a matrix, with a data line connected to pixels arranged along a column direction among the plurality of pixels, and a data signal as described above is supplied to the pixels through the data line. In other words, a plurality of pixels arranged along the column direction are connected to each data line, and, from the point of view of the data signal to be applied to each data line, these connected pixels are equivalent to very large parasitic capacitances (capacitance loads) connected to the data line in parallel. Therefore, in order to supply, to a data line to which such large capacitance loads are connected, a data signal having a sufficiently large amplitude to be able to sufficiently control the switching on and off of the driver TFT 22 in each pixel, it is necessary to employ a circuit with a high driving capability.

In addition, in the time divisional digital gradation driving method it is necessary to provide subfield periods each determined by dividing one frame period by a number equal to a number of data bits determined corresponding to the number of display gradations and to output a data signal in each subfield period. Therefore, compared to a method for achieving a gradation display with an analog signal, for example, the transmission speed of the data signal must be increased and a higher and higher transmission speed would be required as the number of display gradations is increased. However, as described above, the parasitic capacitance connected to the data line to which the data signal is to be output is large, and, thus, it is difficult to output a data signal having a large amplitude to allow sufficient control to switch on and off the driver transistor 22 with a sufficiently high speed, to the data line to which a large parasitic capacitance is connected. Therefore, it is not possible to drive the data line with a high speed in order to increase the number of display gradations and the number of gradations that can be displayed is limited.

The present invention therefore provides a digital light emitting device or display device in which a simple driver circuit is employed and to a digital light emitting device or display device which can be driven at a high speed and in which gradation display can be easily achieved.

SUMMARY OF THE INVENTION

According to one aspect of the present invention, there is provided a light emitting device comprising a driver transistor provided between an emissive element and a power supply, for controlling supply of power from the power supply to the emissive element to drive the emissive element; a control transistor for receiving a digital data signal on a gate and for controlling whether or not to fix a gate potential of the driver transistor to a predetermined potential based on the digital data signal; and a control capacitor connected between a gate of the driver transistor and a control line to which a control pulse signal for controlling a light emission period of the emissive element is supplied, wherein during the light emission period defined by the control pulse signal, the gate potential of the driver transistor is controlled to be shifted or not shifted to a potential corresponding to the control pulse signal based on a digital data signal supplied to the gate of the control transistor and a supply operation of power through the driver transistor to the emissive element is controlled.

According to another aspect of the present invention, there is provided a display device comprising a driver transistor having a first conductive region connected to a display element and a second conductive region connected to a power supply; a control transistor for receiving a digital data signal on a gate and for controlling electrical connection between the power supply and a gate of the driver transistor; and a control capacitor electrically connected between a control line to which a control pulse signal for controlling an element operation period of the display element is applied and a point between a gate of the driver transistor and the control transistor; wherein during the element operation period defined by the control pulse signal a gate potential of the driver transistor is controlled to be shifted or not shifted to a potential corresponding to the control pulse signal based on a digital data signal supplied to the gate of the control transistor and a supply operation of power through the driver transistor to the display element is controlled.

According to another aspect of the present invention, there is provided a display device having a plurality of pixels, wherein each pixel comprises a selection transistor connected to a selection line to which a selection signal is supplied and a data line to which a digital data signal is supplied; an emissive element; a driver transistor provided between the emissive element and a power supply and for controlling supply of power from the power supply to the emissive element to drive the emissive element; a control transistor for receiving a digital data signal on a gate through the selection transistor and for controlling whether or not to fix a gate potential of the driver transistor to a predetermined potential based on the digital data signal; and a control capacitor connected between the gate of the driver transistor and a control line to which a control pulse signal for controlling an element operation period of the emissive element is applied. In addition, during the element operation period defined by the control pulse signal, the gate potential of the driver transistor is controlled to be shifted or not shifted to a potential corresponding to the control pulse signal based on the digital data signal supplied to the gate of the control transistor and s supply operation of power through the driver transistor to the emissive element is controlled.

As described, according to the present invention, it is not necessary to directly control an operation of a driver transistor for controlling, with a digital data signal, supply of power to a display element such as, for example, an organic EL element (power supply operation). With the present invention, the digital data signal is only required to control the operation of the control transistor, that is, switching on and off of the control transistor, to control whether or not the gate potential of the driver transistor is to be fixed to a predetermined potential such as a power supply. In other words, the digital data signal only needs an amplitude for controlling switching on and off of the control transistor and, thus, the amplitude can be reduced compared to a structure in which the operation of the driver transistor is directly controlled. Therefore, it is possible to employ a simple circuit at the processor and output sections for a data signal and the power consumption can be reduced.

In addition, because it is possible to drive the device using a digital data signal having a smaller amplitude, for example, a voltage resistance and a charge supply capability of the selection transistor in each pixel placed on a signal supply route of the digital data signal need not be significantly increased. In addition, even when a storage capacitor for storing a voltage corresponding to the digital data signal for a predetermined period is to be provided, it is possible to use a capacitor with a small capacitance. These transistor and storage capacitor correspond to parasitic capacitances (capacity load) electrically connected to the data line. With the present invention, it is possible to reduce the parasitic capacitance, and thus, it is easy to increase the transfer speed of the data signal. As a result, the requirements for increasing the number of display gradations are simplified.

According to another aspect of the present invention, it is preferable that, in the light emitting device or in the display device, the digital data signal is a digital signal having a plurality of bits, one frame period corresponding to one screen display period is divided into a number of subfield periods, the number corresponding to a number of bits of the digital data signal, and a digital signal of each bit in the digital data signal is supplied to the control transistor in each subfield period.

Moreover, the subfield period may be correlated to each bit of the digital data signal, and a signal having a pulse width corresponding to an element operation period within each subfield period can be supplied to the control line as a control pulse signal. In this structure, it is possible to effectively represent a multi-gradation by assigning weights to each bit in the digital data. It is possible to set the element operation period (light emission period or display period), that is, the pulse width of the control pulse signal, during the subfield period to a width corresponding to a bit of the digital data signal, more specifically, the digit of the bit to accommodate this configuration.

The amplitude of the control pulse signal (in particular, level of the pulse signal) may be set to an amplitude necessary to shift the gate potential of the driver transistor when the potential is not fixed by the control transistor and to switch on and off the power supply operation to the emissive element by the driver transistor around the shifting operation. The control pulse signal is common to all pixels and is required to be output only once each subfield period, and, even when the amplitude of the control pulse signal is large, because the frequency as a pulse signal is low, it is possible to inhibit an increase in the power consumption.

As described, according to the present invention, in a device which emits light for which achieves a display based on digital data, it is only necessary to supply a digital data signal of a minimum amplitude to a data line in which the parasitic capacitance is maintained low, and thus, it is possible to employ a simple driver circuit to realize such a device. Because of this, it is also possible to reduce the power consumption of the device.

Moreover, because it is possible to output a digital data signal at a high speed, a multi-gradation display can be achieved and it is possible to further increase the number of gradations.

DESCRIPTION OF PREFERRED EMBODIMENT

Figure 1:
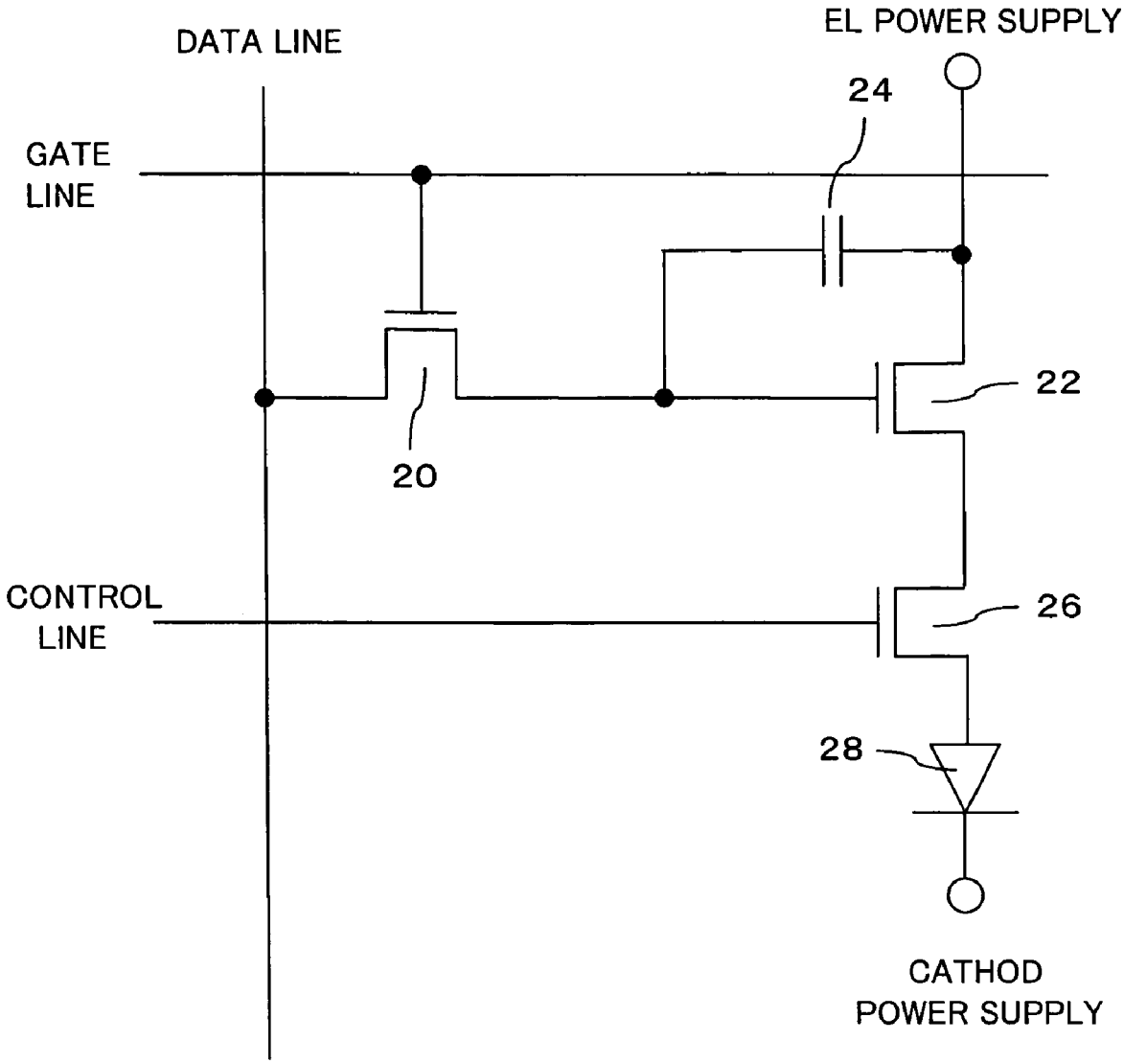
Fig. 1 PRIOR ART
FIG. 1 is a diagram of an equivalent circuit showing a pixel structure of a display device of prior art using a time divisional digital gradation display method.

A preferred embodiment of the present invention will now be described referring to the drawings.

Figure 2:
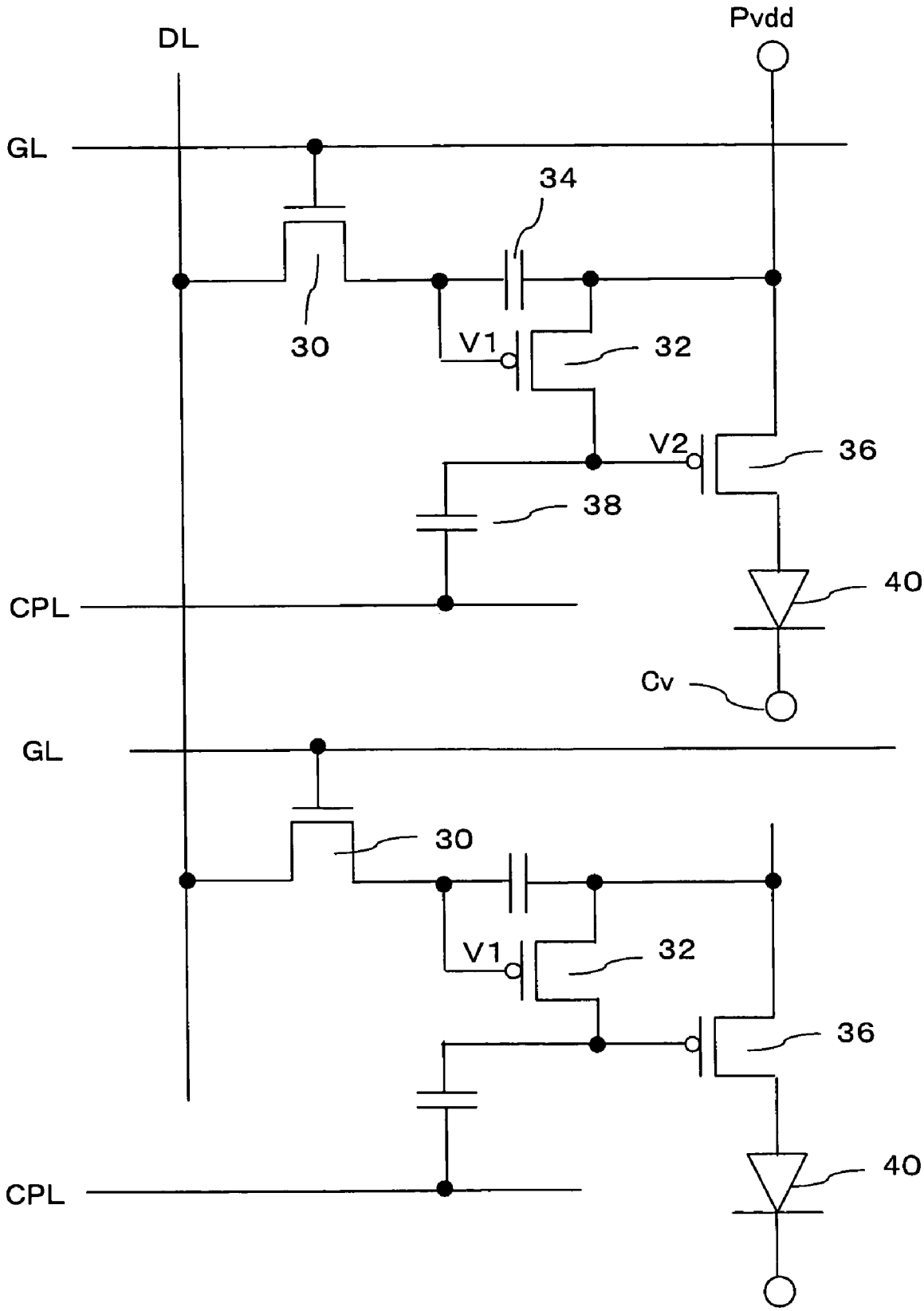
FIG. 2 is an equivalent circuit showing a pixel structure of a display device using a digital gradation display method according to a preferred embodiment of the present invention.

FIG. 2 shows an equivalent circuit showing a pixel among a plurality of pixels arranged in a matrix form in a display region according to a preferred embodiment of the present invention.

In the structure illustrated in FIG. 2, each pixel comprises an organic EL element 40. Each pixel further has a selection transistor (switching transistor; hereinafter also referred to as a "selection TFT") 30, a storage capacitor 34, a control transistor (control TFT) 32, a driver transistor (driver TFT) 36, and a control capacitor 38 for controlling light emitting operation of the organic EL element 40. In addition, a data line DL extending along a vertical scan direction and for supplying a digital data signal to corresponding pixels, a selection line (gate line) extending along a horizontal scan direction and for outputting a selection signal (gate signal) for selecting pixels arranged along a horizontal scan direction, and a control line CPL to which a control pulse signal for controlling light emission time of the organic EL element 40 is supplied are formed over a substrate. An EL power supply Pvdd is connected through the driver TFT 36 on the anode side of each organic EL element 40 having a diode structure. The EL power supply is formed, for example, by power supply lines extending along the vertical scan direction in parallel with the data line and is set to a voltage which is sufficiently higher than that of a cathode power supply Cv to which a cathode of the organic EL element 40 is connected. The cathode power supply Cv is connected to a cathode of the organic EL element 40 which is formed, for example, as a common electrode for a plurality of pixels and determines the cathode potential of each organic EL element 40.

The driver TFT 36 is connected between the anode of the organic EL element 40 and the EL power supply and controls supply of the current, that is, whether or not current is to be supplied, from the EL power supply to the organic EL element 40 based on a voltage applied to a gate of the driver TFT 36. In the present embodiment, the driver TFT 36 is formed from a p-channel TFT and has a source (first conductive region) connected to the EL power supply and a drain (second conductive region) connected to the anode of the organic EL element 40.

The control TFT 32 in the illustrated structure is made of a p-channel TFT and receives, on a gate, a voltage corresponding to a digital data signal supplied through the selection TFT 30, that is, data of "1" or "0". A source (first conductive region) of the control TFT 32 is connected to a predetermined constant voltage power supply and a drain (second conductive region) of the control TFT 32 is connected to the gate (control terminal) of the driver TFT 36. Because of this, when the control TFT 32 is switched on, the gate of the driver TFT 36 is connected to the constant potential power supply through the source and drain of the control TFT 32 and a gate voltage V2 of the driver TFT 36 is fixed to this constant voltage. The constant voltage may be a constant voltage which fixes the driver TFT 36 to an on state or an off state (in the illustrated structure, off state). In the structure of FIG. 2, the EL power supply Pvdd which is set to a sufficiently high voltage is used as the constant voltage power supply and the source of the control TFT 32 is connected to the EL power supply Pvdd. Therefore, when the control TFT 32 is switched on, the gate and the source of the driver TFT 36 are both connected to the EL power supply Pvdd and form a short circuit and the off state is maintained.

The storage capacitor 34 for maintaining a gate voltage V1 of the gate of the control TFT 32 at a voltage corresponding to the supplied digital data signal for a predetermined period (at least for one subfield period which will be described) is connected to the gate of the control TFT 32. More specifically, in the illustrated structure of FIG. 2, one terminal of the storage capacitor 34 is connected to the gate of the control TFT 32 and the other terminal is connected to the source of the control TFT 32 and EL power supply Pvdd.

In the illustrate structure, the selection TFT 30 is an n-channel TFT. A gate of the selection TFT 30 is connected to a gate line GL, a drain of the selection TFT 30 is connected to a data line DL, and a source of the selection TFT 30 is connected to the gate of the control TFT 32 and to the storage capacitor 34.

In addition, a control capacitor 38 is connected between a point between the drain of the control TFT 32 and the gate of the driver TFT 36 and a control line CPL. The control capacitor 38 maintains, while the control TFT 32 is switched on and the gate of the driver TFT 36 is connected to the EL power supply Pvdd, a potential difference between the gate of the driver TFT 36, that is, the EL power supply Pvdd, and the control line CPL (prevents short-circuiting between the control line CPL and the EL power supply) When the control TFT 32 is switched off, the gate of the driver TFT 36 is disconnected from the EL power supply Pvdd, and the gate voltage V2 becomes a non-fixed state, the gate voltage V2 is set to the potential of the control line CPL, that is, a voltage corresponding to the control pulse signal. Therefore, when a control pulse signal having a pulse width for defining the light emission period of the organic EL element 40 is output to the control line CPL, the gate voltage V2 is shifted by an amount corresponding to the amplitude of the pulse signal and is maintained at this voltage until the next changing of the pulse signal voltage.

An operation of the pixel circuit of the present embodiment will now be described in more detail referring to a timing chart shown in FIG. 3 along with FIG. 2. In this description, the number of gradations in the display device is set to 16 and, thus, a digital data signal having 4 bits is used to achieve 16 gradations. In order to realize the 16 gradations through time divisional digital display, one frame period is divided into 4 subfield periods (SF1, SF2, SF3, and SF4) corresponding to the number of bits of the digital data signal. Moreover, in the description, for the ease of description, an example case is described in which the display gradation (light emission intensity) during one frame period of an organic EL element 40 of a pixel of interest is a fifth gradation from the bottom among the 16 gradations (hereinafter referred to as "fifth gradation") and the digital data signal to be supplied to this pixel is "0101". Here, a digital data signal of "0000" represents a zeroth gradation.

Figure 3:
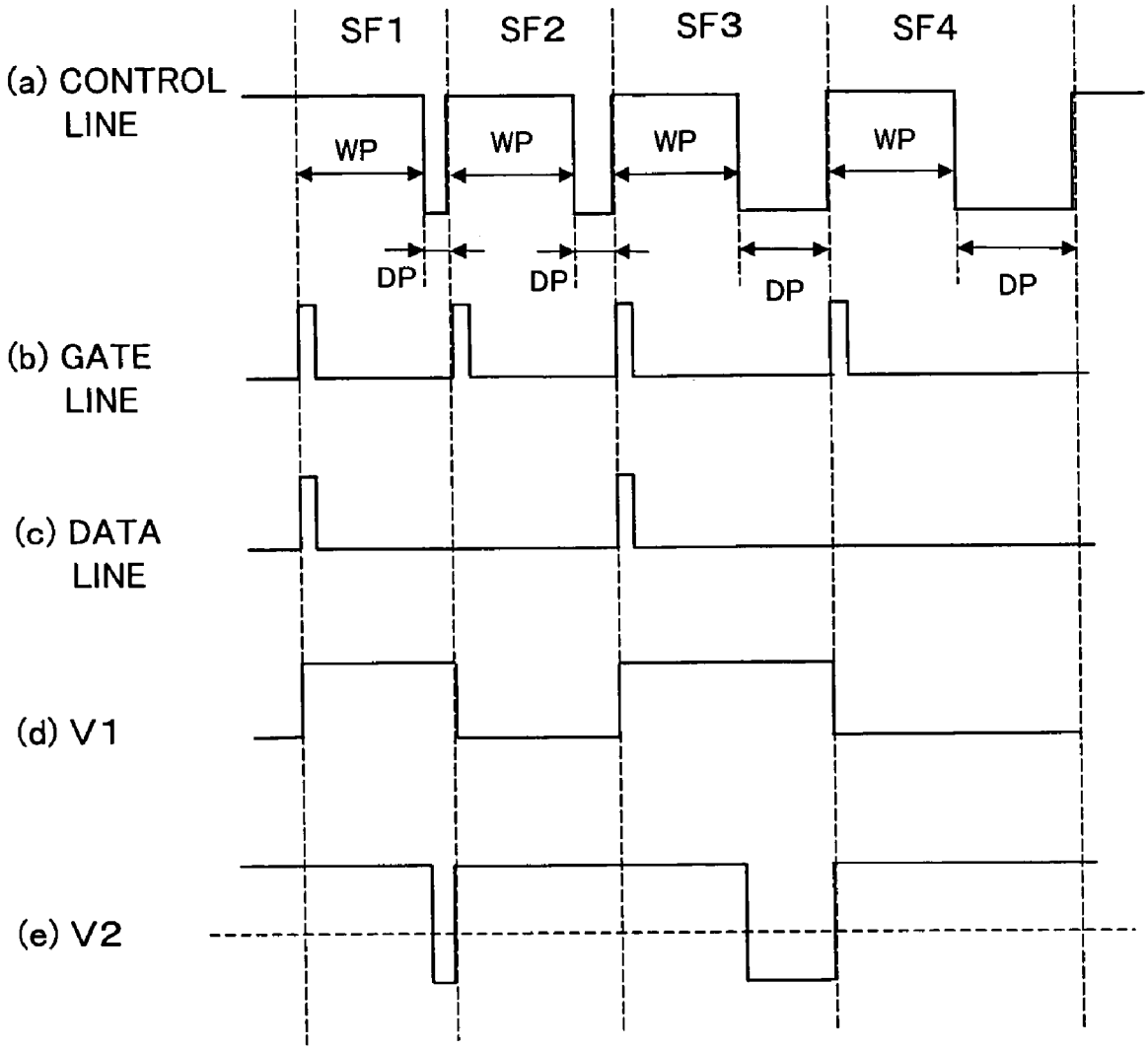
FIG. 3 is a timing chart showing signals for driving a pixel of interest of a display device according to the preferred embodiment of the present invention.

FIG. 3 shows waveforms of a control pulse signal, a selection signal, and a data signal supplied from respective lines to the pixel of interest, a gate voltage V1 of the control TFT 32, and a gate voltage V2 of the driver TFT 36. As described above, in order to realize a 16-gradation display, one frame period is divided into 4 subfield periods and each subfield period is weighted corresponding to the position of the digit of the corresponding bit of the digital data signal. As a result, the length of the subfield periods differ from each other depending on the corresponding bit. In the illustrated structure of FIG. 3, the digital data signal output to the data line is output in order from the lower bit side (first bit) and the corresponding subfield periods SF1-SF4 are configured such that a later subfield has a longer period. When the sequence of output of the digital data signal is from the upper bit side, on the other hand, it is possible to configure the corresponding subfield periods such that a later subfield has a shorter period.

Each subfield period includes a write period WP, in which the digital data signal of corresponding bit is written to each pixel, and a display (light emission) period DP, in which the written data is displayed (light is emitted). The write period WP is constant for every subfield period and the length of the display period DP is set based on the corresponding bit.

As shown in FIG. 3(*a*), a control pulse signal output to the control line corresponds to the lengths of the write period WP and display period DP in each subfield and, in the illustrated configuration, an L level period of the control pulse signal corresponds to the display period DP of each subfield period. In addition, the display period DP of each subfield period (the L level period of the control pulse signal) in this illustrated configuration is set such that when the length of the display period DP in the first subfield SF1 is "one" unit period, the lengths of the display periods DP of the second, third, and fourth subfields SF2, SF3, and SF4 are set respectively to "two", "four", and "eight" unit periods.

The time divisional digital gradation display takes advantage of vision persistence of human eyes. More specifically, as described above, the total length of the cumulative period of light emission during one frame period is adjusted so that the recognized brightness is controlled corresponding to the length of the light emission period. Because a light emission period DP in the subfield period is longer for an upper bit, a plurality of writing period must be provided in each frame period and the total display period is limited. However, with such a structure, it is possible to represent gradations which are bright and have sufficient brightness difference.

When, during a first subfield period SF1, a selection signal on the gate line GL connected to the pixel of interest becomes an H level as shown in FIG. 3(*b*) for a period of one horizontal scan period, the selection TFTs 30 each formed of an n-channel TFT in each pixel and connected to the gate line (row) are switched on. During this process, as shown in FIG. 3(*c*), a digital data signal output on the corresponding data line is supplied to the gate of the control TFT 32 through the selection TFT 30. In the configuration illustrated in FIG. 3(*c*), because the digital data signal during the SF1 period is an H level or "1", the gate voltage V1 of the control TFT 32 also becomes the H level. Even after the selection signal becomes an L level, the selection TFT 30 is switched off, and the data line and the gate of the control TFT 32 are disconnected, the gate voltage V1 is maintained by the storage capacitor 34 at least until the selection signal next becomes the H level and the digital data signal for the next bit is written.

The digital data signal may be maintained in the "1" level or "0" level to be written to the corresponding pixel during the entire period (one horizontal scan period) in which the selection signal (here, H level) is output to the corresponding gate line. Alternatively, when data is to be sequentially written to pixels of each column connected to one horizontal scan line (one gate line) in order, it is also possible to output a digital data signal to the corresponding data line in the same order.

With this configuration, data for one frame of each pixel in the data video signal is stored using, for example, a desired frame memory and the stored data is output to the corresponding data line in order from the lower bit.

Returning to the pixel of interest, as shown in FIG. 3(*d*), when a digital data signal is written in the described manner, a voltage corresponding to the digital data signal is stored in the storage capacitor 34 as the gate voltage V1 of the control TFT 32 for one subfield period (SF1). Here, because the corresponding digital data signal is "1", the gate voltage V1 to be stored is maintained at a predetermined H level. Thus, the control TFT 32 which is formed of a p-channel TFT is maintained in the off state and the gate of the driver TFT 36 is maintained in a disconnected state from the EL power supply Pvdd. As shown in FIG. 3(*a*), the control line CPL connected to the gate of the driver TFT 36 thorough the control capacitor 38 is maintained at the H level during the write period WP, and, during this period, the gate voltage V2 of the driver TFT 36 disconnected from the EL power supply Pvdd is maintained at the H level corresponding to the level of the control pulse signal. As described above, the driver TFT 36 is a p-channel TFT. Therefore, during the period in which the control TFT 32 is switched off and the gate voltage V2 of the driver TFT 36 is fixed to the H level, the driver TFT 36 maintains the off state and no current flows from the EL power supply to the organic EL element 40.

After the write period WP in the first subfield period (SF1) is completed and the control pulse signal on the control line CPL changes to the L level, the gate voltage V2 of the driver TFT 36 which has been fixed to the H level corresponding to the H level of the control pulse signal as described above becomes L level following the level change of the control pulse signal. With this process, the driver TFT 36 becomes an on state and a current is supplied from the EL power supply Pvdd through the source and drain of the driver transistor 36 to the organic EL element 40, so that light is emitted from the organic EL element 40. When the light emission period DP is completed, the timing moves to the next subfield period (SF2), the control pulse signal on the control line CPL again becomes the H level, the gate voltage V2 of the driver TFT 36 becomes the desired H level corresponding to the control pulse signal, the driver TFT 36 is switched off, and emission of light by the organic EL element 40 is stopped.

When the supplied digital data signal is "0", the gate voltage V1 of the control TFT 32 becomes L level. In this configuration, the control TFT 32 is switched on and the gate and the source of the driver TFT 36 are short-circuited and are set to the EL power supply voltage Pvdd. Thus, the gate voltage V2 of the driver TFT 36 maintains the H level even when the control pulse signal becomes the L level during the display period DP, and, because the off state is maintained, no light is emitted from the organic EL element 40.

Therefore, only in a pixel to which a digital data signal of "1" is supplied, the driver TFT 36 is switched on corresponding to the L level of the control pulse signal and light is emitted from the organic EL element 40 during the period when the control pulse signal on the control line CPL becomes an L level, that is, during the period corresponding to the pulse width of the control pulse signal designating an element operation period.

As an example configuration, the H level of the selection signal and the control pulse signal may be set to 8V and the L level of the selection signal and the control pulse signal may be set to −4V, the H level or "1" of the digital data signal may be set to 5V, and the L level or "0" of the digital data signal may be set to 0V. When the gate voltage of the driver TFT is directly controlled with a digital data signal as described referring to FIG. 1, if the characteristics of the driver TFT in the related art are equivalent to those of the driver TFT of the present embodiment, in a simple comparison, it is necessary to employ a signal having an amplitude of 12V from 8V to −4V which is equivalent or greater than that of the control pulse signal. With the structure of the present invention in which the on and off states of the control TFT 32 are controlled with a digital data signal, however, it is possible to use a digital data signal, for example, having an amplitude of 5V as described above.

When the timing moves to the second subfield period (SF2) and a selection signal of H level is applied to the gate line, because the second bit of the digital data signal for the pixel of interest is "0", the voltage of the digital data signal applied through the selection TFT 30 and stored in the storage capacitor 34 becomes a predetermined L level corresponding to "0". Therefore, during the second subfield period SF2, that is, during the period until the gate line becomes the H level during the next, third subfield period SF3 and a digital data signal of the next bit is written, the gate voltage V1 of the control TFT 32 is maintained at the L level and the control TFT 32 is maintained in the on state. Thus, the gate of the driver TFT 36 is fixed to the same potential as that of the EL power supply.

Therefore, even when the control pulse signal on the control line CPL becomes an L level in this state, because the gate of the driver TFT 36 is connected to the EL power supply, the gate voltage V2 is maintained at the H level. Thus, the driver TFT 36 maintains its off state, no current is supplied to the organic EL element 40, and no light is emitted from the organic EL element.

Then, when the timing moves to the third subfield period (SF3) and a selection signal of H level is again applied to the gate line, because the third bit of the digital data signal for the pixel of interest is "1" similar to the SF1 period, during the SF3 period, the gate voltage V1 of the control TFT 32 is maintained at the H level by the storage capacitor 34 and the off state of the control TFT 32 is maintained. Because of this configuration, when the control pulse signal on the control line CPL becomes the L level corresponding to the SF3 period, during this period (DP), the driver TFT 36 is switched on and light is emitted from the organic EL element 40. Here, the length of the display period DP in the SF3 period, that is, the L level period of the control pulse signal is set to four times the length of the display period DP of the SF1 period as described above. Therefore, the length of the light emission period of the organic EL element 40 in the SF3 period is four times that in the SF1 period.

When the timing moves to the fourth subfield period (SF4) and a selection signal of H level is again applied to the gate line, because the fourth bit of the digital data signal is "0" similar to the SF2 period, the control TFT 32 is maintained in its on state, the driver TFT 36 is maintained in its off state even when the control pulse signal changes to the L level, and no light is emitted from the organic EL element 40.

In a pixel to which a digital data signal of "0101" is supplied, light is emitted from the organic EL element 40 for five unit periods during one frame period which comprises subfields SF1-SF4. When the supplied digital data signal is "1111", for example, light is emitted from the organic EL element 40 during all display periods DP in subfields SF1-SF4 so that a fifteenth gradation which represents the maximum brightness is realized. When, on the other hand, the supplied digital data signal is "0000", no light is emitted and a zeroth gradation which represents the minimum brightness is realized. In this manner, according to the present embodiment, each pixel can display any one of 16 gradations (displays of 16 different brightness) in one frame period, and, for example, in the pixel of interest described referring to FIG. 3, display with a fifth gradation (light emission brightness) from the lowest brightness is realized.

According to the present embodiment, the control TFT 32 is the structure which is switched on and off by a digital data signal. The control TFT 32 is only required to control the gate potential of the driver TFT 36 to which the control capacitor 38 is connected to fix the gate potential to a very high EL power supply Pvdd, or to not fix the gate potential, or, in the example circuit of FIG. 2, to control whether to short-circuit or open between the gate and the source of the driver TFT 36. Therefore, the amount of current that must be supplied through the control TFT 32 may be very small, and therefore, it is possible to use a TFT with a small current capability as the control TFT 32. In addition, even when the control capacitor 38 is slightly discharged through leak or the like and the voltage at V2 is slightly reduced while the control TFT 32 is switched on, the control TFT 32 is only required to flow a current necessary for charging the control capacitor 38 from the EL power supply Pvdd, and, moreover, the control TFT 32 need not be fully switched on. In other words, even when the amount of current to be supplied through the control TFT 32 to the gate of the driver TFT 36 varies among pixels due to, for example, characteristic variations in the TFTs, the gate voltage V2 of the driver TFT 36 of every pixel can be set to the EL power supply Pvdd. Therefore, it is sufficient to use a digital data signal having a sufficient amplitude to control on and off states of the control TFT 32 as the digital data signal to be output to the data line and, thus, it is possible to reduce one or more of the required precision or amplitude, as compared to configurations in which the driver TFT 36 is directly controlled. Therefore, even when the number of display gradations is further increased and a higher speed is required for driving, these configurations can be easily accommodated. In addition, because the amplitude of signals to be handled by a circuit for processing and outputting the digital data signal can be reduced, it is possible to reliably drive the structure using a circuit with a lower drive load and simpler structure.

By setting the amplitude of the control pulse signal to be applied to the control line CPL to a sufficiently large amplitude, it is possible to sufficiently switch off or on the driver TFT 36. In particular, by setting the voltage of the L level of the control pulse signal which defines the display period to a voltage which is sufficiently lower than the voltage of the EL power supply, it is possible to switch the driver TFT 36 fully on in a voltage region in which the on resistance is sufficiently small (saturation region). Therefore, it is possible to control the amount of light emission by the organic EL element 40 without being affected by a variation in operation threshold values among the driver TFTs 36 in the pixels. As described before, the control line CPL may be formed to be common to all pixels, and thus, a control pulse signal for defining the write period and display (light emission) period during each subfield period may be output to all pixels.

Although the amplitude of the control pulse signal maybe larger than that of the data signal, it is only required for the control pulse signal that the level of the control pulse signal is inverted during switching between the write period and the display period in each subfield and, therefore, the inversion period is relatively long. Therefore, the load of the control pulse signal on the output circuit is relatively small, and a circuit with a simple structure may be used.

In the present embodiment, a p-channel TFT is employed as the driver TFT 36, but an n-channel TFT may alternatively be employed. In this case, the power supply connected to the source of the control TFT 32 is changed to a constant power supply voltage with a low voltage (for example, the cathode power supply) and the polarity of the control pulse signal is inverted so that the pulse signal which becomes H level during the display period is used. Alternatively, it is also possible to employ an n-channel TFT as the control transistor 32. In this configuration, the polarity of the data signal may be inverted for "1" and "0". In the present embodiment, an n-channel TFT is utilized as the selection TFT 30, but a p-channel TFT may alternatively be employed. In this case, the polarity of the selection signal is inverted.

In the present embodiment, the present invention has been described referring to an example organic EL display device which uses an organic EL element 40 as a display element in each pixel. The present invention is not limited to this structure, however, and similar advantages can be obtained by employing a similar structure in each pixel in an active matrix display device which uses a light emitting element other than the organic EL element 40, such as an organic EL element and other display elements.

What is claimed is:

1. A light emitting device comprising:

a driver transistor provided between an emissive element and a power supply, for controlling supply of power from the power supply to the emissive element to drive the emissive element;

a control transistor for receiving a digital data signal corresponding to emission information on a gate and for controlling whether or not to fix a gate potential of the driver transistor to a predetermined potential based on the digital data signal; and a control capacitor connected between a gate of the driver transistor and a control line to which a control pulse signal for controlling a light emission period of the emissive element is supplied, wherein the gate of the driver transistor is connected to a conductive region of the control transistor which is not connected to the gate of the control transistor, and during the light emission period defined by the control pulse signal, the gate potential of the driver transistor is controlled to be shifted or not shifted to a potential corresponding to the control pulse signal based on the digital data signal supplied to the gate of the control transistor and a supply operation of power through the driver transistor to the emissive element is controlled.

2. A light emitting device according to claim 1, wherein a storage capacitor for storing the supplied digital data signal for a predetennined period is connected to the gate of the control transistor.

3. A light emitting device according to claim 1, wherein the digital data signal is a digital signal with a plurality of bits, one frame period of the device is divided into a number of subfield periods, the number corresponding to a number of bits of the digital data signal, and a digital signal of a corresponding bit in the digital data signal is supplied to the control transistor in each subfield period.

4. A light emitting device according to claim 3, wherein each of the subfield periods comprises:

a write period in which a digital signal of a corresponding bit of the digital data signal is written to the gate of the control transistor, and a light emission period in which supply of power to the emissive element is controlled based on the written digital signal.

5. A light emitting device according to claim 3, wherein a signal with a pulse width corresponding to the light emission period within each subfield period is output to the control line as the control pulse signal.

6. A light emitting device according to claim 5, wherein the pulse width of the control pulse signal corresponding to the light emission period within each subfield period differs depending on the corresponding bit in the digital data signal.

7. A display device comprising:

a driver transistor having a first conductive region connected to a display element and a second conductive region connected to a power supply;

a control transistor for receiving a digital data signal corresponding to display content on a gate and for controlling electrical connection between the power supply and a gate of the driver transistor; and a control capacitor electrically connected between a control line to which a control pulse signal for controlling an element operation period of the display element is applied and a point between a gate of the driver transistor and the control transistor, wherein the gate of the driver transistor is connected to a conductive region of the control transistor which is not connected to the gate of the control transistor, and during the element operation period defined by the control pulse signal, a gate potential of the driver transistor is controlled to be shifted or not shifted to a potential corresponding to the control pulse signal based on the digital data signal supplied on the gate of the control transistor and a supply operation of power through the driver transistor to the display element is controlled.

8. A display device according to claim 7, wherein a storage capacitor for storing the supplied digital data signal for a predetermined period is connected to the gate of the control transistor.

9. A display device according to claim 7, wherein the digital data signal is a digital signal having a plurality of bits, one frame period of the device is divided into a number of subfield periods, the number corresponding to a number of bits of the digital data signal, and a digital signal of a corresponding bit in the digital data signal is supplied to the control transistor in each subfield period.

10. A display device according to claim 9, wherein each of the subfield periods comprises:

a write period in which a digital signal of a corresponding bit of the digital data signal is written to the gate of the control transistor, and an element operation period in which supply of power to the display element is controlled based on the written digital signal.

11. A display device according to claim 9, wherein a signal with a pulse width corresponding to the element operation period within the subfield period is output to the control line as the control pulse signal.

12. A display device according to claim 11, wherein the pulse width of the control pulse signal corresponding to the element operation period within each subfield period differs depending on the corresponding bit in the digital data signal.

13. A display device having a plurality of pixels, wherein each pixel comprises:

a selection transistor connected to a selection line to which a selection signal is supplied and to a data line to which a digital data signal corresponding to display content is supplied;

an emissive element;

a driver transistor provided between the emissive element and a power supply and for controlling supply of power from the power supply to the emissive element to drive the emissive element;

a control transistor for receiving a digital data signal on a gate through the selection transistor and for controlling whether or not to fix a gate potential of the driver transistor to a predetermined potential based on the digital data signal; and a control capacitor connected between a gate of the driver transistor and a control line to which a control pulse signal for controlling an element operation period of the emissive element is supplied; wherein the gate of the driver transistor is connected to a conductive region of the control transistor which is not connected to the gate of the control transistor, and during the element operation period defined by the control pulse signal, the gate potential of the driver transistor is controlled to be shifted or not shifted to a potential corresponding to the control pulse signal based on the digital data signal supplied to the gate of the control transistor and a supply operation of power through the driver transistor to the emissive element is controlled.

14. A display device according to claim 13, wherein one frame period comprises a number of subfield periods, the number corresponding to a number of bits in the digital data signal;

a control pulse signal having a predetermined pulse width is supplied to the control line in each of the number of subfield periods, and the pulse width of the control pulse signal in each subfield period is set to a width corresponding to the corresponding bit of the digital data signal.

* * * * *